United States Patent [19]

Tanner et al.

[11] Patent Number: 4,547,030

[45] Date of Patent: Oct. 15, 1985

[54] ELECTRICAL DISTRIBUTION SYSTEM

[75] Inventors: Peter R. Tanner, Barking; Eric Chaplin, Eastleigh, both of England

[73] Assignee: Tanner Chaplin Tracks Ltd., Barking, England

[21] Appl. No.: 441,527

[22] PCT Filed: Mar. 30, 1982

[86] PCT No.: PCT/GB82/00097

§ 371 Date: Nov. 5, 1982

§ 102(e) Date: Nov. 5, 1982

[87] PCT Pub. No.: WO82/03505

PCT Pub. Date: Oct. 14, 1982

[30] Foreign Application Priority Data

| | | | |
|---|---|---|---|
| Mar. 31, 1981 | [GB] | United Kingdom | 8109995 |
| Jun. 11, 1981 | [GB] | United Kingdom | 8117998 |
| Sep. 15, 1981 | [GB] | United Kingdom | 8127792 |

[51] Int. Cl.[4] ..... H01R 9/00

[52] U.S. Cl. ..... 339/21 R; 339/23

[58] Field of Search ..... 339/20, 21 R, 22 R, 339/22 B, 23; 174/97, 101

[56] References Cited

U.S. PATENT DOCUMENTS

| | | | |
|---|---|---|---|
| 1,877,103 | 9/1932 | Whiting | 339/22 R |
| 2,313,452 | 3/1943 | O'Brien | 339/23 |
| 3,308,416 | 3/1967 | Boyd | 339/22 R |
| 3,569,898 | 3/1971 | Laser | 339/21 R |
| 3,613,045 | 10/1971 | Routh | 339/21 R |
| 3,760,133 | 9/1973 | Howard | 339/21 R |
| 3,786,171 | 1/1974 | Shiva | 174/48 |
| 4,017,137 | 4/1977 | Parks | 339/21 R |

*Primary Examiner*—Gil Weidenfeld
*Assistant Examiner*—Thomas M. Kline
*Attorney, Agent, or Firm*—Wells & Wells

[57] ABSTRACT

A conduit having socket positions spaced along its length comprises a rear member 50 secured to a wall, a cover member 10 attached to the rear member and an elongate insulating member 30 which prevents conductors 70,71,72 from being exposed when the cover member is detached from the rear member. The insulating member 30 may be attached to both members 10 and 50 with the attachment to the cover member 10 being stronger than the attachment to the rear member 50. The pins of an electrical plug pass through openings in the cover member to electrically contact the conductors 70,71,72.

9 Claims, 12 Drawing Figures

ELECTRICAL DISTRIBUTION SYSTEM

The present invention relates to an electrical distribution system of the type in which a plurality of electrical conductors are housed in a conduit which permits the access of the pins of electrical plugs at a plurality of positions along the conduit.

Such systems are disclosed in U.S. Pat. Nos. 1,877,103 and 2,313,452. The conduit of U.S. Pat. No. 1,877,103 comprises a central member positioned between two cover members. The conduit of U.S. Pat. No. 2,313,452 comprises a front cover member attached to a rear member. A disadvantage of such arrangements is that when the cover members are removed the electrical conductors become externally accessible, which can be dangerous.

According to the present invention there is provided an electrical distribution system including a conduit comprising an elongate rear member and an elongate cover member attachable to the rear member, the conduit containing a plurality of electrical conductors and having therealong a plurality of socket positions for receiving an electrical plug member, each electrical conductor having along its length a series of contact elements each shaped to receive pins of the electrical plug member, characterised in that the conduit further contains an elongate insulating member having means for attaching it to the rear member and/or the cover member, the arrangement being such that, when the cover member is detached from the rear member, the insulating member prevents the electrical conductors from being exposed.

An advantage of this system is that the cover member may be safely removed from the rear member without any danger of electric shock.

In preferred arrangements according to the invention the elongate insulating member has first means for attaching it to the rear member and second means for attaching it to the cover member, said second attaching means being stronger than said first attaching means such that, when the cover member is detached from the rear member, the insulating member is readily detached from the rear member and remains securely attached to the cover member.

Such arrangements permit the easy assembly of the conduit by first mounting the insulating member on the rear member and then mounting the cover member on to the rear member (and simultaneously attaching it to the insulating member), while still ensuring that the insulating member and the cover member do no become detached when the latter is removed from the rear member. Preferably the elongate insulating member defines a duct with the cover member, the bare electrical conductors being mounted on the insulating member inside the duct, the arrangement being such that the pins of an electrical plug pass through the cover member at a said socket position to engage the contact elements of the electrical conductors within said duct.

In accordance with a further preferred feature of the invention the cover member is of generally channel-shaped cross-section comprising a web portion and two arm portions of rigid plastics material, the web portion being connected to the arm portions by pieces of flexible plastic material serving as hinge means. This permits the cover member to be readily removed from the rear member when desired by moving the arm portions outwardly, the pieces of flexible plastics material permitting such movement.

A preferred embodiment of the present invention will now be described, by way of example only with reference to the accompanying drawings of which:

FIGS. 1, 2 and 3 respectively show cross-sectional views of the cover member, the elongate insulating member and the rear member of an electrical distribution system in accordance with the present invention;

Figure 10:
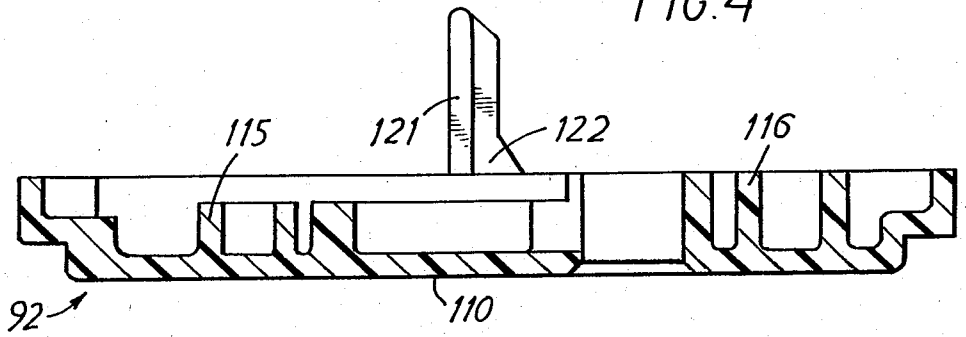
Figure 8:
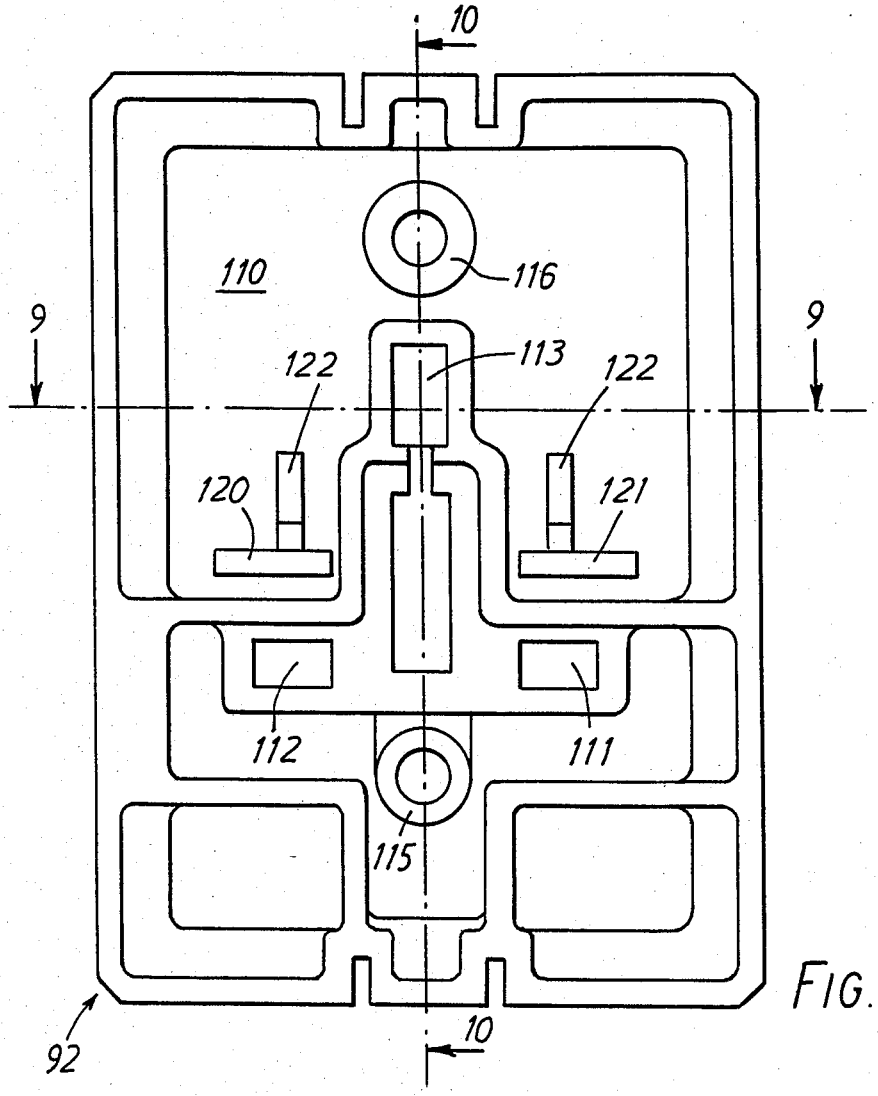
FIG. 8 is a plan view of the front part of the socket member.
Figure 9:
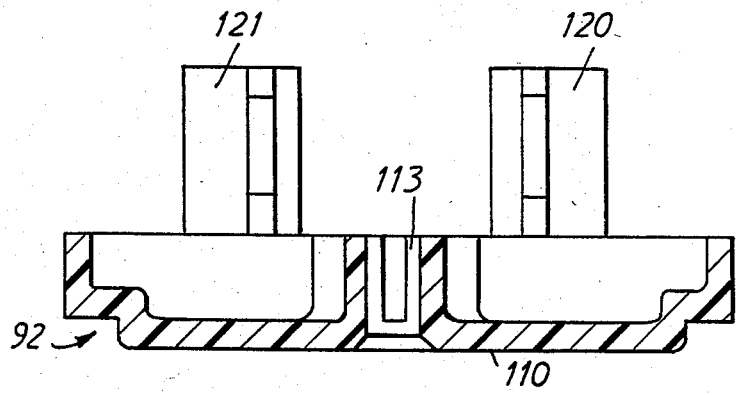
Figure 11:
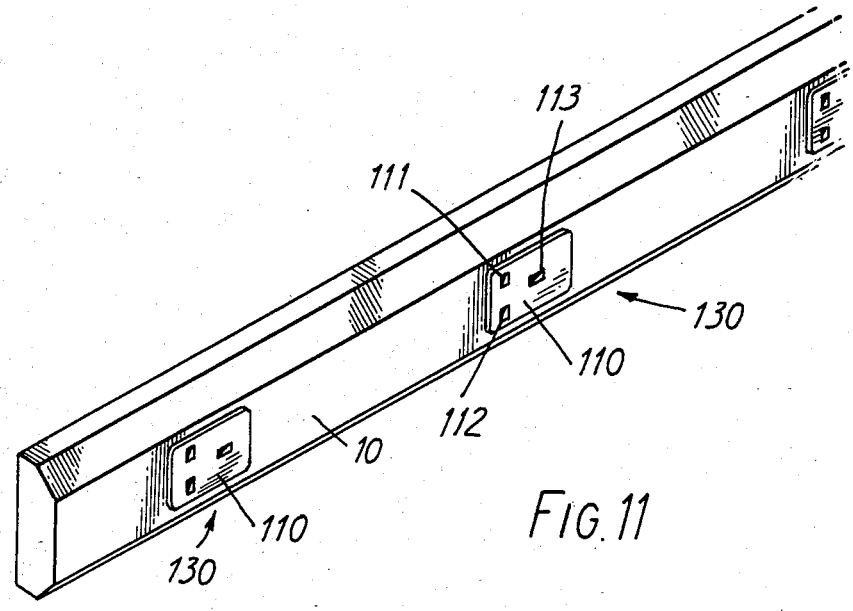
Figure 12:
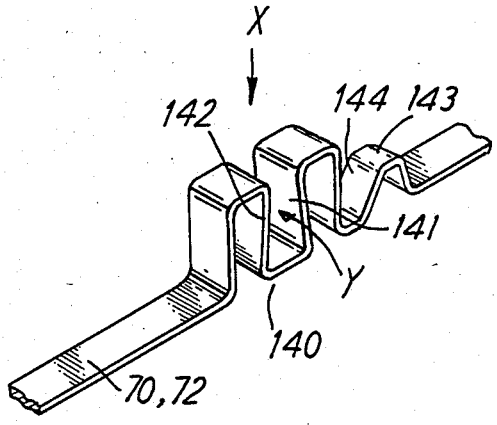

FIGS. 9 and 10 are transverse and longitudinal sectional views respectively taken on the lines 9—9 and 10—10 of FIG. 8;

FIG. 11 shows a perspective view of a length of conduit of the electrical distribution system; and FIG. 12 shows an enlarged view of part of a conductor of the system.

Figure 1:
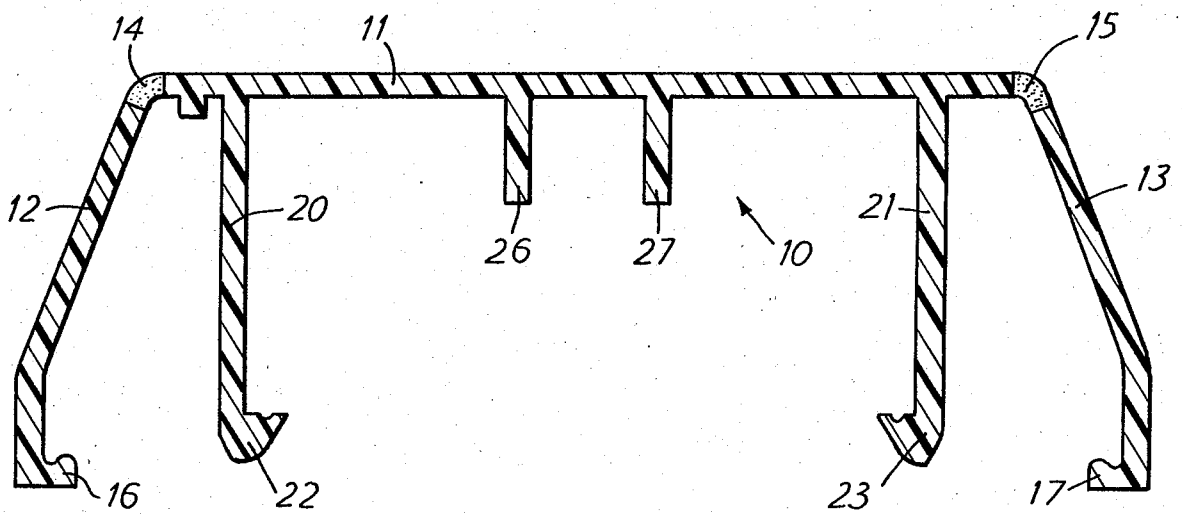

Referring now to FIG. 1, there is shown a cross-section of an elongate cover member 10, which is of a material such as plastics or a metal alloy. The cover comprises a front or web portion 11 and two side or arm portion 12,13. Whereas portions 11,12 and 13 are of a relatively rigid material, corners or hinge pieces 14,15 are of relatively flexible material to readily permit outward movement of portions 12,13. The ends of arm portions 12,13 are provided with attachment means in the form of hook members 16,17.

Between arm portions 12,13 and also extending from web portion 11 there are a pair of further arms 20,21, having further hook members 22,23 at their ends. Further portions 26,27 project from the central region of portion 11.

Figure 2:
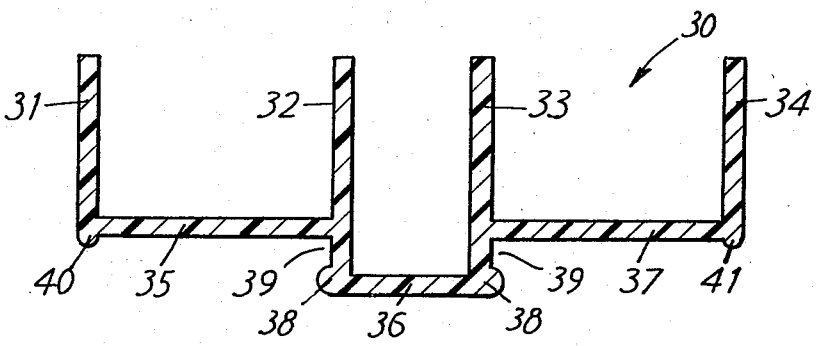

FIG. 2 shows a cross-section of an elongate insulating member 30 which is also of insulating material. The insulating member has four arm portions 31–34 and three web portions 35–37 which define three channels. Web portion 36 projects beyond the other web portions and terminates in protrusions 38, which define recesses 39. Arm portions 31,34 terminate in similar protrusions 40,41.

Figure 3:
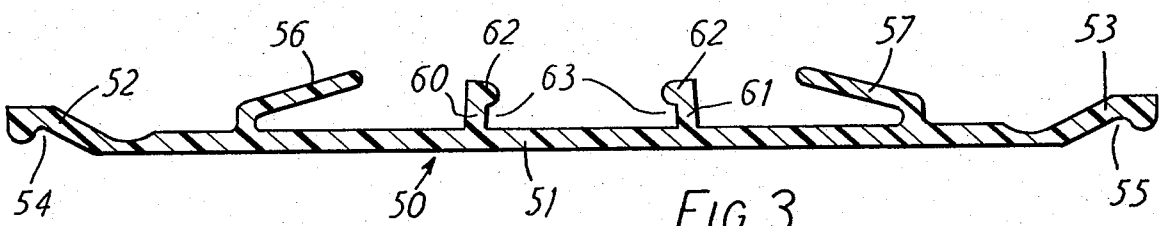

FIG. 3 shows a cross-section of an elongate rear member 50 which is of insulating material and can be secured to a wall by means now shown. The rear member comprises a web-portion 51 at the end of which angled portions 52,53 define recesses 54,55. Between portions 52,53 and extending from web portion 51 are a pair of bent arm portions 56,57. Further portions 60,61 project from the central region of portion 51. Portions 60,61 have protrusions 62 which define recesses 63.

Figure 4:
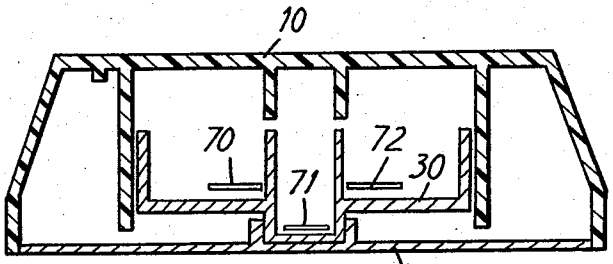
FIG. 4 is a cross-sectional view on a smaller scale of the members of FIGS. 1, 2 and 3 in their assembled condition.
Figure 5:
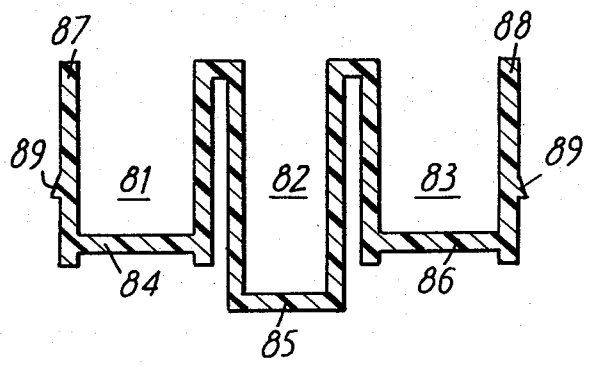
FIG. 5 is a cross-sectional view of a barrier member provided at the socket positions of the conduit.

The cover, insulating and rear members 10,30 and 50 interfit as indicated in FIG. 4, which does not show the means for attaching the members together. Insulating member 30 is first attached to the rear member 50 by snapping web portion 36 into position between portions 60,61. The members are held together by protrusions 62 entering recesses 39 and by protrusions 38 entering recesses 63. Web portions 35,37 of the insulating member rest on arm portions 56,57 of the rear member.

Front member 10 is then attached to the already-assembled members 30 and 50. Hook members 22,23 engage protrusions 40,41 of the insulating member and hook members 16,17 engage in recesses 54,55 of the rear member. The attachment (defined by means 22,23,40 and 41) between the cover member and the insulating member is arranged to be stronger than the attachment (defined by means 38,39,62 and 63) between the insulating member and the rear member. Accordingly when arms 12 and 13 are moved outwardly to release the attachment (defined by means 16,17,54 and 55) between the cover members and the rear member, and the cover member is pulled, the insulating member is detached from the rear members and remains securely attached to the cover member along its length.

The conduit has three bare flat conductors 70,71,72 mounted on the web portions 35,36,37 of the elongate insulating member. The cover, insulating and rear members may be provided in lengths of any desired size, with their ends provided with means for connecting them to an adjacent member. Suitably-shaped members (not shown) may be provided where the conduit is to go round an internal or external cover.

The members provided for joining adjacent lengths may be non-conductive i.e. they may be only decorative to continue the external line of the conduit. In this case, suitable non-conducting pins or projections are provided to engage the openings in the end cross-section. If the circuit is to be continuous, a combination of conducting and non-conducting projections will be required. Such junction members may incorporate a switch to isolate one or other length.

At each end of a single or multiple length, a suitable end cap is provided, one forming a junction box to permit wiring-in of the conduit, the other blanking-off the other ends of the conductors.

An advantage of the above described arrangement is that the conductors 70,71,72 are not exposed when the cover member is removed. Thus if the wall on which the conduit is mounted is being painted, the electric supply to the conductors does not need to be switched off. There is even no need to remove the rear members from the wall, since it is easy to paint the wall as far as necessary up to the web portion 51 whilst avoiding painting angled portions 52,53.

A plurality of electrical sockets are provided at desired positions along the length of the conduit, the cover member being provided with a rectangular opening at each such position. Aligned with the opening and lying below the conductors is a flame proof barrier member 80 having substantially the same length along the conduit as the opening. The barrier member comprises three channels 81,82,83 which are arranged to fit into the three channels of the insulating member 30, web portions 84,85,86 lying over web portions 35,36,37 respectively. The end arms 87,88 of the barrier member have projecting noses 89.

A socket member is positioned over each barrier member, each socket member comprising a rear part 91 and a front part 92.

Figure 6:
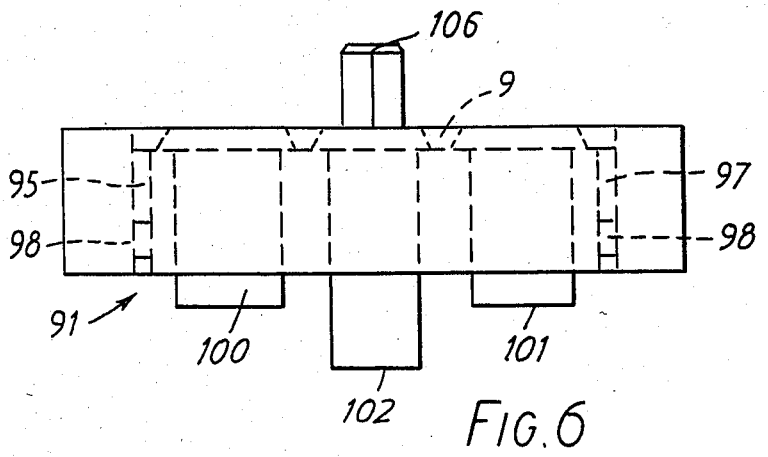
FIGS. 6 and 7 are end and plan views respectively of the rear part of a socket member of the system.
Figure 7:
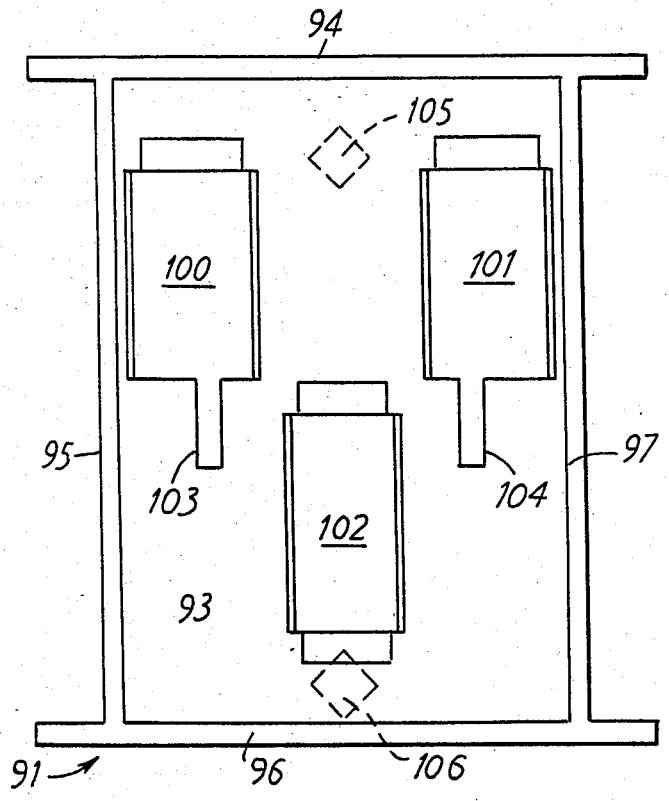

The rear part 91, shown in FIGS. 6 and 7 comprises a base 93 and four walls 94–97, walls 95 and 97 having slots 98 therein. Slots 98 are arranged to latchingly receive the noses 89 when the rear half of the socket is located on the barrier member 80. The rear of the base 93 has three passages 100,101,102 for the pins of an electrical plug. Aligned edges of passages 100,101, have slots 103,104. The front of the base 93 is formed with the two projecting pegs 105,106 of which peg 106 is slightly larger than peg 105 for orientation purposes.

The front part 92 of the socket member is shown in FIGS. 8 to 10. The front wall 110 of the part 92 is arranged to be generally flush with the front face of the cover member 10. The front wall has three apertures 111,112, and 113 which define the conventional socket apertures for receiving a three pin 13-amp plug which is conventional in Great Britain. A resiliently-biassed slider plate of conventional type may be provided to the rear of openings 111,112 and 113, said plate preventing entry of a pin through either of apertures 111 or 112 until the plate has been displaced by a pin entering aperture 113.

Round bosses 115,116 project from the rear face of wall 110, boss 115 being slightly smaller than boss 116 so that when the front part is assembled with the rear part, pegs 105,106 mate with the correct boss 115,116 respectively.

Also projecting from the rear face of wall 110, there are two projections 120,121 of generally T-shaped cross-section, see FIG. 8. The central branch of each T has a sloping edge 122 between its central region and the wall 110. As the front and rear parts of the socket member are assembled together the edges 122 enter the slots 103,104 in the edges of the passages 100,101 of the rear part.

FIG. 11 shows a perspective view of a length of conduit with socket positions 130. A plug is inserted at a desired socket position. The earth pin of the plug passes through aperture 113 in the front wall 110 of part 92, through passage 102 of the rear part and into channel 82 of the barrier member 80 to contact conductor 71. The live and neutral pins of the plug similarly pass through the apertures and passages in the socket parts to contact conductors 70 and 72.

FIG. 12 shows a preferred method of providing good electrical contact between a pin and its respective conductor. This is done by bending the conductor itself into the form of a sinuous loop 140 which is adapted to receive a flat plug pin, which is standard in Great Britain, in the direction X. FIG. 12 shows a conductor suitable for receiving the live and neutral plug pins; the earth conductor is bent to define a slightly larger gap between parts 141,142 of the loop to receive the conventional earth pin.

A third deflection 143 of the conductor 70 has a sloping surface 144. The wedge-shaped recess so formed is shaped and positioned to receive the projection 120 (or 121) on the rear of the front face of the socket member (see FIG. 10). Their respective sloping surfaces produce a mutual camming action and location of the projection in the recess which ensures accurate alignment of the contact element 141,142 with the corresponding aperture of the socket member, while allowing for manufacturing tolerances in production of the long conductors.

In an alternative arrangement the conductors have separate contact elements connected thereto for the receipt of the plug pins. As shown the conductors are positioned parallel to and adjacent the web portions of insulator member 30, in alternative arrangements one or more of the conductors may be positioned parallel to and adjacent one of the arm portions 31–34. In this case the pins of an electrical plug may enter sinuous loops in the conductors from the side, i.e. from the direction Y in FIG. 12. This arrangement can be used to provide socket positions with the earth pin at the top, and live and neutral at the bottom.

Although an electrical distribution system has been described for use with the 3-pin 13 amp plug conventional in Great Britain, the system may readily be modified for use with plugs having any number of pins, and for pins of any shape. In particular, the conductor in FIG. 12 may additionally be shaped across its width so that the parts 141,142 form a circular, or part-circular, contact element to receive a round pin. If a pin is to be inserted in direction Y, the parts 141,142 may alternatively be curved convexly across their width to receive a flat pin.

We claim:

1. An electrical distribution system including a conduit comprising an elongate rear member and an elongate cover member, said cover member being of generally channel-shaped cross-section comprising a web portion and two arm portions and said cover member being attachable to said rear member by attachment means provided at the ends of said arm portions remote from said web portion, said conduit containing a plurality of electrical conductors and having therealong a plurality of socket positions adapted to receive an electrical plug member having contact pins, each said electrical conductor having along its length a series of contact elements, each said contact element being arranged to contact said pins of the electrical plug member, and said conduit further containing an elongate insulating member for preventing said electrical conductors from being exposed when said cover member is detached from said rear member, and said insulating member having means for attaching it to said cover member, wherein said insulating member also has means for attaching it to said rear member.

2. A system according to claim 1 wherein said web portion and said arm portions are of relatively rigid material and are connected together by pieces of relatively flexible material serving as hinge means.

3. A system according to claim 1, wherein said arm portions are hinged to said web portion, said insulating member is attachable to said web portion, and said attachment means at the ends of said arm portions are releasable from said rear member without detaching said cover member from said insulating member or said insulating member from said rear member.

4. A system according to claim 1 wherein, said means for attaching said insulating member to said cover member are stronger than said means for attaching said insulating member to said rear member such that, when said cover member is detached from said rear member, said insulating member is readily detached from said rear member and remains securely attached to said cover member.

5. A system according to claim 1 wherein said elongate insulating member defines a duct with said cover member, said electrical conductors being mounted on said insulating member inside said duct, the arrangement being such that said pins of the electrical plug member pass through said cover member at one of said socket positions to engage said contact elements of the electrical conductors within said duct.

6. A system according to claim 1 wherein said conductors are parallel flat conductors and said contact elements are formed by said conductors being formed as sinuous loops, said pins of the electrical plug member being arranged to enter said loops in a direction perpendicular to the plane of said flat conductors.

7. A system according to claim 6 wherein further sinuous loops are formed in said conductors and each said socket position is provided with a projecting peg, each said further loop serving as location means for a respective one of said projecting pegs, whereby said contact element is accurately located to receive a said pin of the electrical plug member.

8. A system according to claim 7 wherein said further loop and said peg have mutually camming surfaces.

9. A system according to claim 1 wherein, when said cover member is attached to said rear member, said arm portions of said cover member are spaced from adjacent parts of said rear member whereby to provide enclosed spaces between said cover member and said adjacent parts of said rear member.

* * * * *